United States Patent [19]

Senften

[11] 4,284,861

[45] Aug. 18, 1981

[54] SWITCH HINGE

[75] Inventor: David A. Senften, Florissant, Mo.

[73] Assignee: Hager Hinge Company, St. Louis, Mo.

[21] Appl. No.: 110,603

[22] Filed: Jan. 9, 1980

[51] Int. Cl.[3] ..... H01H 3/16

[52] U.S. Cl. ..... 200/61.7

[58] Field of Search ..... 200/61.7, 61.81, 61.82

[56] References Cited

U.S. PATENT DOCUMENTS

| | | | |
|---|---|---|---|
| 3,715,537 | 2/1973 | Peterson | 200/61.7 |
| 3,840,715 | 10/1974 | Gwozdz | 200/61.7 |
| 4,049,934 | 9/1977 | Newlon | 200/61.7 |
| 4,066,857 | 1/1978 | Suska | 200/61.7 |
| 4,150,265 | 4/1979 | Holden | 200/61.7 |
| 4,168,409 | 9/1979 | McNinch | 200/61.7 |

FOREIGN PATENT DOCUMENTS

| | | | |
|---|---|---|---|
| 1279381 | 6/1972 | United Kingdom | 200/61.7 |

*Primary Examiner*—James R. Scott

*Attorney, Agent, or Firm*—Gravely, Lieder & Woodruff

[57] ABSTRACT

A switch hinge includes door and jamb leaves having aligned knuckles through which a hinge pin extends. The hinge pin is fixed firmly in position with respect to the knuckles of the door leaf, and within one of the knuckles of the jamb leaf it has an eccentric camming surface. The jamb leaf has a transverse bore that extends from the region of the camming surface in its knuckle to the opposite side edge of the leaf, and intermediate the ends of the bore the jamb leaf is further provided with a recess that opens solely out of its back face. The bore contains a push rod which is threaded through an actuator within the recess, and this actuator is located opposite to a switch that is mounted firmly on the back of the jamb leaf. A coil-type compression spring encircles the push rod within the recess and urges it toward the hinge pin with sufficient force to enable the actuator to depress the actuating element on the switch when the hinge is closed. When the leaves spread apart as the door is opened, the camming surface drives the push rod outwardly and moves the actuator away from the switch, thereby causing the switch to change condition. The precise angular position at which the switch changes condition may be adjusted by engaging the push rod with a tool from the open end of the bore and turning the push rod. The leaves also contain wire channels that lead to unoccupied regions of two of the knuckles for accommodating through wires.

16 Claims, 6 Drawing Figures

FIG. 1
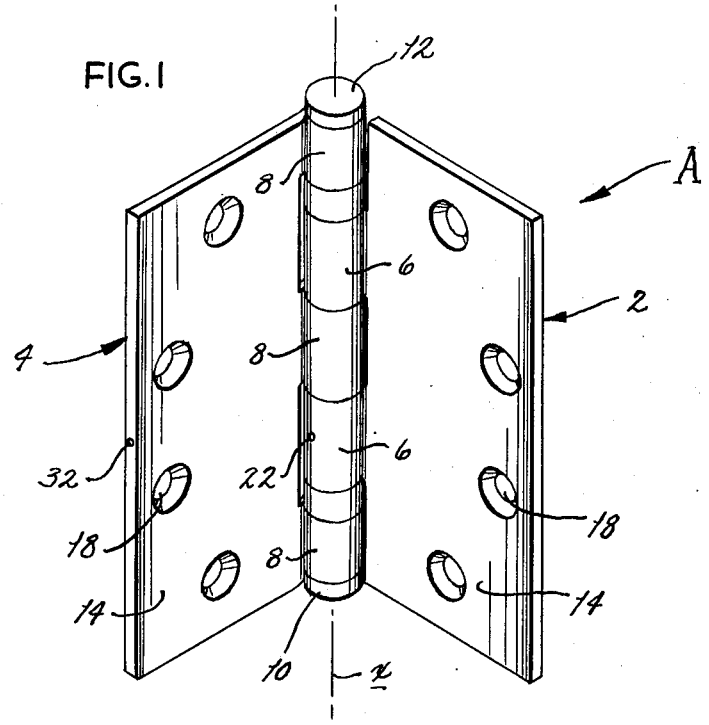
FIG. 2
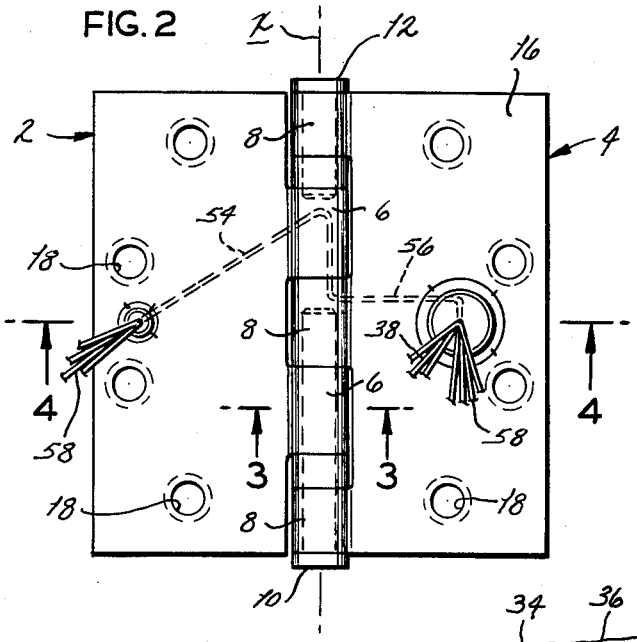
FIG. 3
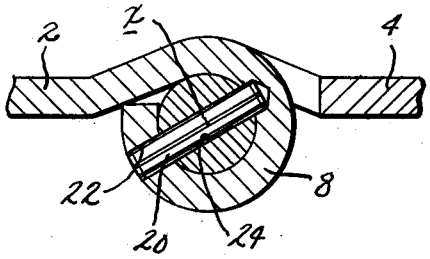
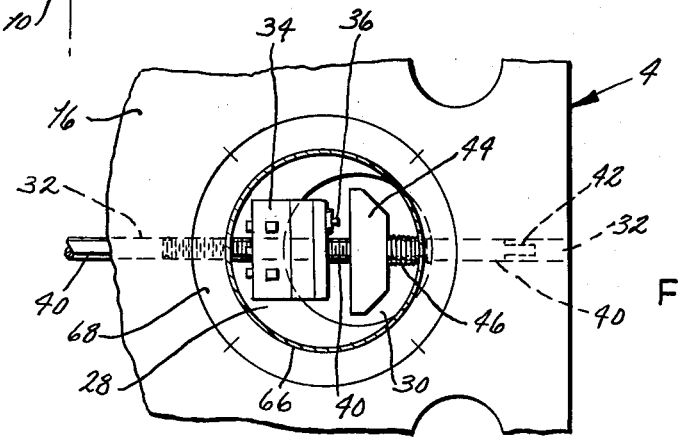
FIG. 6

SWITCH HINGE

BACKGROUND OF THE INVENTION

This invention relates in general to hinges and more particularly to a switch hinge, that is, a hinge that is capable of making and breaking an electrical circuit.

The need to maintain surveillance over the entryways of buildings from central locations lead to the development of a wide variety of so-called switch hinges, that is, hinges having switches which will make or break an electrical circuit in response to the movement of the hinge leaves. One type of switch hinge has the switch, or at least the push button for the switch, exposed when the hinge is open. This invites intruders to tamper with the hinge and its switch and furthermore alerts intruders that the entry is under surveillance. The intruder will therefore seek some other entry into the building. A typical switch hinge of this variety appears in U.S. Pat. No. 3,715,537.

Another type of switch hinge contains a magnetic reed switch in one leaf and a magnet in the other leaf. When the leaves are brought together, the field of the magnet brings the reeds of the switch into contact and completes a circuit. A hinge of this variety must be made from a nonmagnetic material such as brass, and furthermore it is difficult to control the point at which the switch is actuated. U.S. Pat. Nos. 3,806,852 and 3,896,404 illustrate magnetic switch hinges.

Still another type of switch hinge has a button-type microswitch housed entirely within a knuckle for one of the hinge leaves. The switch is operated by the hinge pin which is fixed firmly in the knuckles of the other leaf, and normally some type of camming device is interposed between the push button of the switch and the hinge pin so that when the leaves move in relation to each other, the hinge pin depresses the switch button. A hinge of this variety is quite complicated and expensive to manufacture, and furthermore the switch and the camming device occupy portions of the knuckles which might otherwise be occupied by the hinge pin, thereby making the hinge somewhat weaker and less durable than hinges of conventional construction. Also, the hinge pin is normally secured in one of the knuckles by a set screw which is turned down against the side of the pin. While this provides a means for adjusting the angle at which the switch is actuated, it does not enable the adjustment to be performed with the precision that is required in many situations. In particular, the set screw, when turned down against the hinge pin, leaves a slight indentation or dimple in the pin. It is impossible to reset the screw a few degrees off of this dimple, for the screw will merely drop back down into the original dimple. Hinges of this variety appear in U.S. Pat. Nos. 4,066,857, 4,049,934 and 4,168,409.

Another switch hinge, which in effect houses the switch in a knuckles on one of the leaves, utilizes a slip ring assembly to make and break the electrical circuit, this being achieved by interrupting one of the slip rings so that when the contactor which normally bears against that slip ring comes to the dead spot, the circuit is interrupted. These switch hinges have generally the same deficiencies as switch hinges provided with microswitches in their knuckles. A slip ring-type switch hinge forms the subject matter of U.S. Pat. No. 3,838,234.

Yet another type of switch hinge has a spring loaded push rod that extends laterally through one of the leaves to the hinge pin and is moved axially by a camming surface on the hinge pin. The push rod in turn has a camming surface that bears against the actuator of a switch that is fitted to the leaf through which the rod extends. The hinge pin is secured to a knuckle of the other leaf by a set screw and as a consequence, it is difficult to adjust the angle at which the switch will operate with any precision. A switch hinge of this variety is illustrated in U.S. Pat. No. 3,840,715.

SUMMARY OF THE INVENTION

One of the principal objects of the present invention is to provide a switch hinge that is capable of making and breaking an electrical circuit in response to relative movement between the hinge leaves. Another object is to provide a switch hinge of the type stated wherein the angle at which the switch is actuated can be adjusted with considerable precision. A further object is to provide a switch hinge of the type stated in which the switch is completely concealed when the hinge is installed on a door and door jamb so as to be tamper proof. An additional object is to provide a switch hinge of the type stated that is highly compact and easy to install. Still another object is to provide a switch hinge of the type stated through which a concealed electric wire extends so that an electrical circuit may be extended into a door. These and other objects and advantages will become apparent hereinafter.

The present invention is embodied in a hinge having first and second leaves provided with knuckles through which a hinge pin extends. The hinge pin is fixed in position with respect to the knuckle of the first leaf and within the knuckle of the second leaf has a camming surface. The knuckle of the second leaf has a guideway that leads up to the interior of the knuckle on that leaf in the region of the camming surface, and a push rod extends along that guideway. Means are provided for urging the push rod toward the hinge pin. A first switch means is mounted upon the second leaf, while second switch means is mounted upon the push rod such that its position upon the push rod can be adjusted. One of the switch means is capable of changing the condition of an electrical circuit when actuated while the other is capable of operating that switch means. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a perspective view of a switch hinge constructed in accordance with and embodying the present invention, the hinge being partially open;

FIG. 2 is an elevational view of the back of the hinge with the hinge in its fully opened condition;

FIG. 3 is a sectional view taken along line 3—3 of FIG. 2 and showing the cross pin which prevents the hinge pin from rotating with respect to the door leaf;

FIG. 6 is a sectional view taken along line 6—6 of FIG. 4.

DETAILED DESCRIPTION

Figure 4:
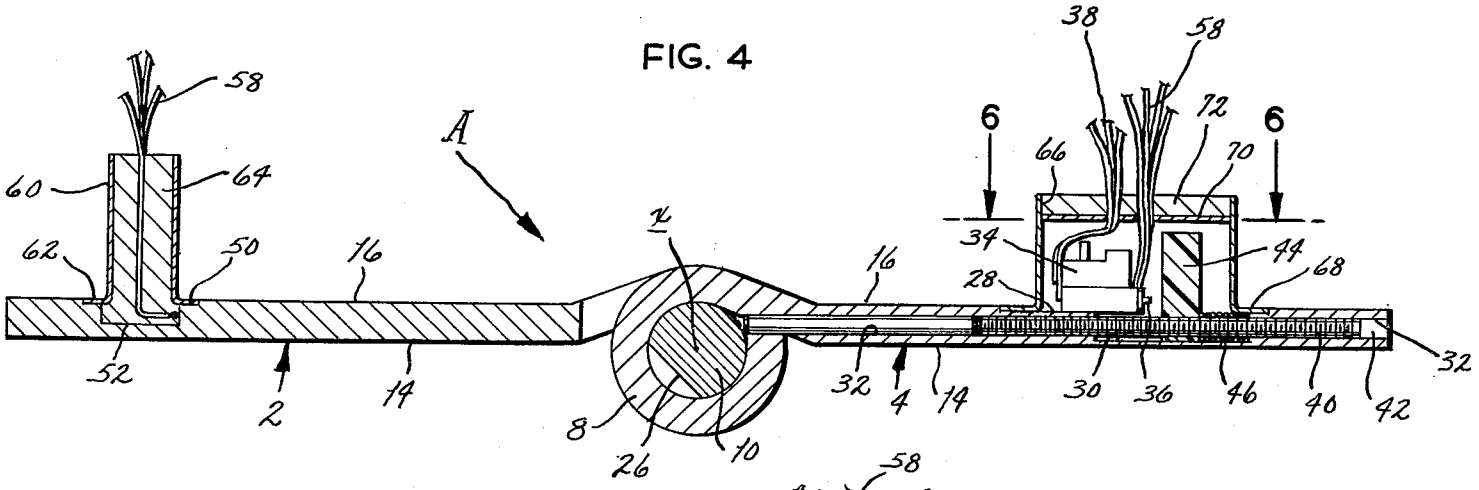
FIG. 4 is a sectional view taken along line 4—4 of FIG. 2 and showing the switch and the push rod which operates the switch.

Referring now to the drawings, a hinge A is capable of suspending a door from the jamb of a door frame and is further capable of interrupting or completing an electrical circuit in response to movement of the door with respect to the door frame. In addition, the hinge A possesses the capability of extending electrical circuits from the hinge jamb into the door in a fully concealed manner.

Figure 5:
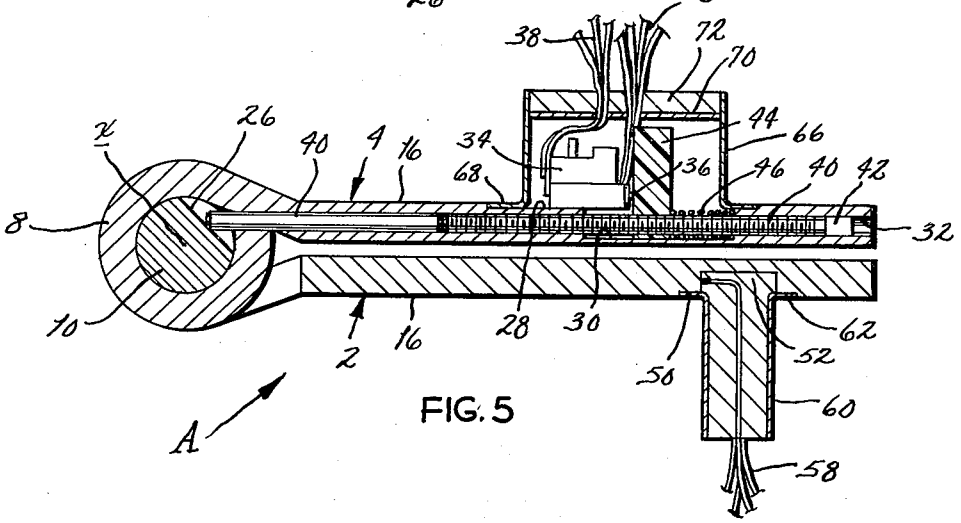
FIG. 5 is a sectional view similar to FIG. 4 but showing the hinge in its closed position with the actuator depressing the button on the switch.

The hinge A includes two hinge leaves 2 and 4 (FIGS. 1 and 2), each of which for the most part is flat. However, along one of its side edges the leaf 2 has two rolled knuckles 6 which are spaced apart, while the leaf 4 along one of its side edges has three rolled knuckles 8 which are likewise spaced apart, yet are offset with respect to the knuckles 6 to enable the two leaves 2 and 4 to fit together with their knuckles 6 and 8 in alignment along a hinge axis x. The arrangement is such that the two knuckles 6 of the leaf 2 are set inwardly from the end edges of the leaf 2. On the other hand, two of the knuckles 8 on the leaf 4 extend out to the end edges of that leaf, while the third knuckle 8 is located in the center of the leaf 4. The two leaves 2 and 4 are held together at their knuckles 6 and 8 by long and short hinge pins 10 and 12. The long hinge pin 10 fits through the end knuckle 8 on the leaf 4, then through the adjacent knuckle 6 on the leaf 2, and finally into the center knuckle 8 on the leaf 4, where it terminates intermediate the ends of that knuckle. The short hinge pin 12 extends through the knuckle 8 at the opposite end of the leaf 4 and terminates a short distance within the adjacent knuckle 6 of the leaf 2. The hinge axis x lies coincident to the axis of the two pins 10 and 12, and indeed the two leaves 2 and 4 pivot relative to each other about the pins 10 and 12 between open positions and a closed position. When the hinge A is in any of its open positions the hinge leaves 2 and 4 are spread apart (FIG. 4). When in the closed position the leaves 2 and 4 are generally parallel and close together, facing each other along front faces 14 (FIG. 5). Of course, while the front faces 14 of the leaves face each other when the hinge A is closed, the back faces 16 are presented away from each other. Each leaf 2 and 4 further has screw holes 18 which are countersunk from the front faces 14 of the leaves 2 or 4.

To accommodate the hinge A, both the door and the hinge jamb to which the hinge A is fitted are provided with mortises. The hinge leaf 2 is normally installed in the mortise of the door with the back face 16 of the leaf against the bottom of the mortise, while the leaf 4 normally fits into the mortise of the hinge jamb with its back face 16 presented against the bottom of that mortise. Hence, the leaf 2 is called the door leaf and the leaf 4, the jamb leaf. The two leaves 2 and 4 are secured in place by screws which extend through the holes 18.

Aside from being longer than the short hinge pin 12, the long hinge pin 10 pivots with ease in the knuckles 8 of the jamb leaf 4. Furthermore, it is secured within the knuckle 6 of the door leaf 2 by means of a cross pin 20 (FIG. 3) that passes through aligned cross bores 22 and 24 in the knuckle 6 and pin 10, respectively, the bores 22 and 24 being perpendicular to and intersecting hinge axis x. The pin 20 may be a so-called roll pin. Near its end, which is within the center knuckle 8 of the jamb leaf 4, the pin 10 has a land 26 (FIGS. 4 and 5) which is presented generally toward the segment of the center knuckle 8 that merges into the flat portion of the leaf 4, at least when the hinge A is closed (FIG. 5).

Referring now to the jamb leaf 4, it has very shallow recess 28 (FIGS. 4–6) of circular configuration opening out of its back face 16 midway between its ends, and extending into the leaf 4 from the base of the recess 28 is another circular recess 30 of smaller diameter. Moreover, the recess 30 is offset from the center of the recess 28 toward the free side edge of the leaf 4 (FIG. 6). The bases or bottoms of the two recesses 28 and 30 are flat, with the bottom of the recess 30 being quite close to the front face 14, but nevertheless completely concealed by the front face 14. The leaf 4 also contains a small bore 32 which extends from the free side edge of leaf 4 through the small recess 30 to the center knuckle 8 where it opens toward the hinge pin 10. Indeed, the bore 32 terminates in the region of the land 26 on the pin 10. Moreover, the bore 32 extends parallel to the front and back faces 14 and 16 and perpendicular to the axis x, and throughout its length it is completely concealed to an observer looking at the front faces 14 and 16 which is all that is visible when the leaves 2 and 4 are set into their respective mortises.

Since the recess 30 is eccentric to the recess 28, a considerable portion of the recess 28 lies to the side of the recess 30, and this portion of the recess 28 is located toward the center knuckle 8. Mounted upon the bottom of the enlarged portion of the recess 28 is a microswitch 34 having a push button 36 that projects toward the free side edge of the leaf 4. Moreover, the path of operation for the button 36 is generally parallel to the axis of the bore 32, but is offset rearwardly from the bore 32. The body of the switch 34 may be secured to the hinge leaf 2 in any suitable manner, a highly suitable one being a strong bonding agent such as an epoxy resin glue. In any event, the body of the switch 34 is attached firmly to the leaf 4 in a manner which does not obstruct the small transverse bore 32. The switch 34 has wires 38 connected to it and into an electrical circuit, these wires extending rearwardly away from the back face 16 of the leaf 4.

Extended through the bore 32 for substantially its full length is a push rod 40 (FIGS. 4 and 5) that fits loosely, so that it can reciprocate easily within the leaf 4, toward and away from the hinge pin 10. The inner end of the rod 40 bears against the hinge pin 10 in the region of the land 26, and indeed will bear against the land 26 when the hinge A is closed (FIG. 5). The outer end of the rod 40 has parallel flats 42 so that it resembles a screw driver blade. This end is accessible from the end of the transverse bore 32, but only after the jamb leaf 4 has been removed from the mortise of the hinge jamb in which it is installed. The flats 42 permit the rod 40 to be turned by a special tool that fits into the end of the bore 32 and is configured to engage the rod 40. In lieu of the flat 42, the end of the rod 40 may have a cross slot, so that it can be engaged by a small screw driver and turned.

That portion of the rod 40 which passes through the small recess 30 is threaded and the threads are engaged with a switch actuator 44 (FIGS. 4–6) that projects outwardly from the recess 30 and has one of its faces located opposite to the button 36 of the microswitch 34. Another surface of the actuator 44 is located along the flat base of the recess 30 and this surface serves to guide the actuator 44 over the base while preventing it from rotating on the rod 40. The push rod 40 further extends through a coil-type compression spring 46 which is located between the side of the recess 30 and the back of the actuator 36. The spring 46 urges the actuator 44 toward the switch 34 with sufficient force to enable the actuator 44 to depress the plunger 36 on the switch 34, unless the end of the rod 40 is obstructed by the hinge pin 10.

The orientation of the hinge pin 10 within the knuckles 8 of the door leaf 4 is such that when the hinge A is closed (FIG. 5), the land 26 on the pin 10 is located opposite the inner end of the push rod 40. As a consequence, the spring 46 thrusts the rod 40 inwardly and the actuator 44 bears against and depresses the button 36 on the switch 34, thereby altering the condition of the switch 34. However, as the hinge A opens, the hinge pin 10 turns within the center knuckle 8 of the jamb leaf 4, causing the land 26 to cam or force the push rod 40 backwardly, that is away from the knuckle 8. This moves the actuator 44 away from the switch 34, and shortly the button 36 of the switch 34 reaches a position in which the switch 34 changes condition. The angular position of the hinge leaves 2 and 4 when this change occurs is known as the set point, and the set point may be varied with considerable precision by turning the push rod 40 so as to change the position of the actuator 44 upon it. Thus, the switch 34 together with the actuator 44 which it operates constitute separate components of switch means for controlling the condition of the circuit in which the switch 34 is located.

The door leaf 2 midway between its ends is provided with a shallow circular recess 50 that opens out of its back face 16 and another recess (FIGS. 4 and 5) that is concentric to, yet smaller in diameter than, the recess 50. Also extended somewhat obliquely through the leaf 2 is a wire channel 54 (FIG. 2) that passes through the recess 52 and opens into that knuckle 6 into which the end of the short hinge pin 12 projects. The jamb leaf 4, likewise has a wire channel 56, but this channel extends transversely through the leaf 4, passing through the recess 30 to the side of the switch 34 and then into the bore of the center knuckle 8 slightly beyond the end of the hinge pin 10. The wire channels 54 and 56 together with the unoccupied portions of the bores in the knuckle 6 serve as a conduit for several wires 58 that are capable of extending an electrical circuit through the hinge A and into the door. The wires 58, which are independent of the switch 34, emerge from the door leaf 2 at the recess 52, and leave the jamb leaf 4 at the recesses 28 where they pass to the side of the microswitch 34 and the actuator 44 which operates it.

Upon turning outwardly from the back face 16 of the door leaf 2, the wires 58 pass through a tube 60 having a flange 62 at its lower end. The flange 62 fits into the recess 50 of the leaf 2 and is staked firmly in place. The tube 60 as well as the recess 52 that underlies it are filled with a potting compound 64 in which the wires 58 are embedded. Similarly, the jamb leaf 4 has a tube 66 extended from its rear surface, but that tube 66 is large enough to enclose the switch 34 and its actuator 44 as well as the wires 38 and 58. The tube 66 at its one end is provided with a flange 68 that fits within the large recess 28, it being secured in place by staking. Rearwardly beyond the switch 34 and its actuator 44, the tube 66 is fitted with a cross wall 70 through which the wires 38 and 58 pass, and the region beyond the cross wall 70 is filled with a potting compound 72 in which the wires 38 and 58 are embedded.

OPERATION

To install the hinge A both the hinge jamb and the edge of the door are provided with mortises that are sized and configured to receive the leaves 2 and 4 of the hinge A. In addition, the edge of the door is drilled through the base of its mortise to provide a hole which will accommodate the tube 60 that extends from the back face 16 of the door leaf 2. Similarly, the hinge jamb is drilled to provide a somewhat larger hole that will accommodate the tube 66 which extends from the back face 16 of the jamb leaf 4.

Before the leaves 2 and 4 are fitted to the mortises, the actuator 44 is positioned on the push rod 40 such that its location will operate the switch 34 at the desired angle between the two hinge leaves. This is achieved merely by inserting the adjusting tool into the end of the push rod 42. When the tool is turned, the actuator 44 moves either toward or away from the long hinge pin 10 and switch 34, depending upon the direction of rotation. Once the desired set point is acquired, the wires 38 and 58 are connected to appropriate wires in the door and jamb, and then the leaves 2 and 4 are installed within their respective mortises and attached firmly to the edge of the door and to the hinge jamb by means of screws that extend through the screw holes 18.

When the door is in its closed position, the camming surface or land 26 upon the long hinge pin 10 will be located opposite the end of the push rod 40, and the spring 46 will urge the push rod 40 toward the pin 10 (FIG. 5). Indeed, the force exerted by the spring is sufficient to press the actuator 44 against the button 36 of the switch 34 with enough force to depress that button.

As the door is opened, the hinge leaves 2 and 4 pivot with respect to each other and move apart. The hinge pin 10, being fixed in position with respect to the knuckles 6 of the door leaf 2, rotates within the knuckles 8 of the jamb leaf 4, and as a consequence, the land 26 moves over the end of the push rod 40 and forces the push rod 40 outwardly. This of course, moves the actuator 44 away from the switch 34, and eventually the button 36 of the switch 34 comes to a position in which the condition of the switch 34 changes. The angle between the leaves 2 and 4 at which this change in condition occurs is the so-called set point of the hinge A. The set point may be varied by withdrawing the jamb leaf 4 slightly from its mortise to expose to the end of the bore 32 so that the adjusting tool may be inserted into the bore 32 to turn the push rod 40.

When the hinge A is securely installed, the edges of the jamb leaf 4 are fully obscured by the mortise so that in outward appearance of the hinge A is indistinguishable from a conventional butt hinge. Thus, potential intruders are not likely to tamper with it. Even if such intruders are aware of the fact that the hinge A monitors the door that it supports, there is little that such intruders can do to disarm the hinge A since it is virtually tamper-proof when installed on the hinge jamb and door edge.

If it is necessary to extend an electrical circuit into a door to provide additional security or supply electrical power to an appliance on the door, the wires 58 may be used for this purpose. Of course, it is possible to supply the hinge A without the through wires 58, and in that event the hinge pin 10 may be extended through all of the knuckles 6 and 8 without interruption. This makes the hinge A comparable in strength to conventional butt hinges. However, even when the hinge A is supplied with the through wires 58, the hinge A still possesses substantial strength, since the two hinge pins 10 and 12 extend past all but one of the bearing surfaces for the adjoining knuckles 6 and 8.

This invention is intended to cover all changes and modifications of the example of the invention herein chosen for purposes of the disclosure which do not constitute departures from the spirit and scope of the invention.

What is claimed:

1. A hinge comprising: first and second hinge leaves each having at least one knuckle, with the knuckles of the leaves being offset from, yet aligned with, each other, the second leaf further having a guideway that opens into the interior of the knuckle on that leaf; a hinge pin located within the knuckles of the leaves to enable the leaves to pivot relative to each other about the axis of the pin, the hinge pin being fixed in position with respect to the knuckle of the first leaf and having a camming surface within the knuckle of the second leaf, with the camming surface being in the region of the end of the guideway, so that as the leaves pivot with respect to each other, the camming surface will move within the knuckle of the second leaf; a push rod located along the guideway and being capable of moving axially therein, the push rod having its end located close enough to the camming surface to be engaged by the caming surface so that the push rod will move axially as the leaves pivot with respect to each other; means for urging the push rod toward the hinge pin within the knuckle of the second leaf; and switch means for changing the condition of an electrical circuit in response to movement of the push rod along the guideway, said switch means including a first component mounted in a fixed position on the second leaf and a second component mounted on the push rod such that it projects laterally therefrom, whereby the relative positions of the first and second components change as the push rod moves along the guideway in response to pivoting movement of the hinge leaves, the second component further being secured to the push rod such that its axial position along the push rod can be altered with relative ease, one of the components being an electrical switch that is in the electrical circuit and the other of the components being an actuator which operates the switch and causes the switch to change condition as relative movement occurs between the switch and the actuator.

2. A hinge according to claim 1 wherein the switch is on the second leaf and the actuator is on the push rod.

3. A hinge according to claim 1 wherein the hinge leaves have front faces which are presented toward each other when the hinge is in a closed position and back faces which are presented away from each other when the hinge is closed, and wherein the first and second components of the switch means are completely obscured by the front face of the second leaf, but project beyond the rear face.

4. A hinge according to claim 1 wherein the guideway is a channel that extends through the second leaf; and wherein the push rod is threaded and the threads along it are engaged with the second component of the switch means, the push rod being capable of being rotated within the channel to change the position of the second switch means along it.

5. A hinge according to claim 1 wherein the second leaf has a recess that opens out of its back face at the channel such that the channel is interrupted by the recess; and wherein the push rod extends through the recess and the second component of the switch means is on the portion of the push rod that is in the recess.

6. A hinge according to claim 5 wherein the portion of the push rod that is within the recess contains threads and is threaded through the second component of the switch means.

7. A hinge according to claim 6 wherein the means for urging the push rod toward the hinge pin includes a coil-type spring which encircles the push rod and at one end bears against the side of the recess and at its other end bears against the second component of the switch means.

8. A hinge according to claim 6 wherein the channel is a bore that extends through the second leaf generally perpendicular to the hinge pin.

9. A hinge according to claim 8 wherein the bore at its end opens out of an edge of the second leaf and the end of the push rod is accessible for turning from that end of the bore.

10. A hinge according to claim 2 wherein the switch includes an actuating element that moves generally parallel to the push rod and the actuator bears against the actuating element to change the condition of the second switch means as the push rod moves in the proper direction along the guideway.

11. A hinge capable of moving between open and closed positions and comprising: first and second leaves, each having at least one knuckle which is offset from, yet aligned with the knuckle of the other leaf, the leaves having front faces which are presented toward each other and back faces which are presented away from each other when the hinge is closed, the second leaf further having a recess which opens out of its back face and a bore that leads from the recess to the interior of the knuckle on that leaf with the bore being generally perpendicular to the axis of the knuckles; a hinge pin fixed in position with respect to the knuckle of the first leaf and being extended into the knuckle of the second leaf, the hinge pin being generally round but in the region of the end of the bore having a camming surface that is not concentric to the axis of the pin; a push rod extended through the bore and recess and having threads in the region of the recess; means for urging the push rod toward the pin within the knuckle of the second leaf; an actuator within the recess and engaged with the threads of the push rod, whereby the actuator will move with the push rod; and a switch mounted upon the second leaf and having an actuating element that is in the path of the actuator so that the actuator as it moves on the push rod engages the actuating element and operates the switch.

12. A hinge according to claim 11 wherein the actuating element on the switch is a button that moves generally parallel to the bore.

13. A hinge according to claim 11 wherein the switch and the actuating element project beyond the back face of the second leaf.

14. A hinge according to claim 11 wherein the means for urging the push rod toward the hinge pin comprises a coil-type compression spring that encircles the push rod and extends between a wall of the recess and the actuator.

15. A hinge according to claim 11 wherein the bore opens out of one edge of the second leaf and the end of the push rod is accessible through the end of the bore, so that the push rod may be turned to change the location of the actuator upon the push rod.

16. A hinge pin according to claim 11 wherein each of the leaves has a plurality of knuckles, with the knuckles on the first leaf being offset and alternated relative to the knuckles on the second leaf; wherein the hinge pin is interrupted so that a void exists in two adjoining knuckles of the first and second leaves; wherein the first leaf has a wire channel that extends through the first leaf and into the void in the knuckle of that leaf; and wherein a wire extends through the two wire channels and the void within the adjoining knuckles.

* * * * *